United States Patent [19]

Keyser

[11] Patent Number: 4,489,948

[45] Date of Patent: Dec. 25, 1984

[54] COLOR CARD PACK

[76] Inventor: A. Lynn Keyser, 419 W. 10th Ave., Huntington, W. Va. 25701

[21] Appl. No.: 555,813

[22] Filed: Nov. 28, 1983

[51] Int. Cl.[3] ..... A63F 1/00

[52] U.S. Cl. ..... 273/306; 273/269

[58] Field of Search ..... 273/292, 303, 306, 269

[56] References Cited

U.S. PATENT DOCUMENTS

| | | | |
|---|---|---|---|
| 1,204,834 | 11/1916 | Williams | 273/306 |
| 1,723,377 | 8/1929 | Salomon | 273/269 |
| 1,738,902 | 12/1929 | Howard | 273/292 |
| 3,663,021 | 5/1972 | Whippo | 273/296 |
| 4,428,582 | 1/1984 | Smith | 273/296 |

FOREIGN PATENT DOCUMENTS

| | | | |
|---|---|---|---|
| 1401881 | 4/1965 | France | 273/303 |

*Primary Examiner*—Anton O. Oechsle

*Attorney, Agent, or Firm*—Sherman & Shalloway

[57] ABSTRACT

A pack of cards is disclosed which enables the users thereof to play a wide variety of card games. The pack includes 55 cards arranged in 10 different colors with 50 of the cards being arranged in 5 different colored suits groups of 10 cards each and the remaining 5 cards being of colors different from one another and from the colors of the above described 5 suits. In playing the above noted games, sometimes not all of the above described cards are used, however, in other games all of the above described cards are used therein. One of the above noted games is titled "Quest" and will be described in detail hereinafter.

2 Claims, 2 Drawing Figures

COLOR CARD PACK

BACKGROUND OF THE INVENTION

This invention relates to a new pack of playing cards. In the prior art, numerous types of playing card decks are known with the deck including suits of hearts, diamonds, clubs and spades and each suit including numbered cards from ace to 10 and jack, queen and king being the most common. The following prior art is known to applicant:

U.S. Pat. No. 848,542 to Ferris discloses a deck of playing cards including 4 sets of suit cards with each such suit comprising 10 digit cards correspondingly colored and the plurality of "interchanger cards" having a portion colored to correspond to their main suit and a portion thereof colored to correspond to the color of another suit. The object is to force play to another suit. In a modification of the invention an ordinary deck as described above is used and the interchanger cards are added to thereby comprise a deck including 64 cards.

U.S. Pat. No. 952,939 to Parker discloses a deck of playing cards wherein specific suits are designated by an area of color and the name of the color is printed thereon. The individual cards in each suit are distinguished by the display of identifying symbols such as numerals which may or may not run in sequence as desired. To play games with this deck of cards, the object is to match sums of numbers as well as colors.

U.S. Pat. No. 1,614,132 to Keating discloses a deck of cards designed to enable playing a game similar to that of rummy which requires the collection of cards bearing pictures of various sled dogs and respective drivers having the same color suits.

U.S. Pat. No. 1,738,902 to Howard discloses a deck of cards having 62 cards therein which is designed to play a card game entitled "Rainbow". The 62 card deck includes 6 suits of 10 cards, each suit of which is provided with a color section comprising the same major or base color together with a different and distinguishing minor color section there being only 2 cards per suit having the same combination. The remaining 2 cards represent a pot of gold and an empty pot. The object of the game is to make books of cards bearing the 6 base colors of the rainbow.

U.S. Pat. No. 1,775,782 to Pearson discloses a card game played with a deck of cards consisting of 4 suits of unique colors each of which contains 13 cards and each designated with numbers representing the "taking value" and the "score value". As the taking value increases, the scoring value decreases and vice versa. The game played with this deck of cards may be considered to be a variation of the game of "bridge".

U.S. Pat. No. Des. 162,756 to Shriner discloses a design for a deck of playing cards wherein the suits are designated by symbols such as stars, circles or tree-like symbols. The respective suit symbols are located within a triangle which is inversely placed within a larger triangle about which certain numbers are written for a variety of reasons.

SUMMARY OF THE INVENTION

Accordingly, it is a first object of the present invention to provide a new deck of playing cards.

It is a further object of the present invention to provide a new deck of playing cards which includes cards preferably of 10 different colors.

It is a still further object of the present invention to provide such a deck with 5 suits of 10 cards each and 5 further cards each one of which being unique in itself.

It is a yet further object of the present invention to make the above described 5 suits in 5 respective unique colors and to make the additional 5 individual cards of 5 further individual colors whereby a total of 10 colors are provided for a deck of 55 cards.

It is a still further object of the present invention to provide such a deck of cards which enables the playing of a plurality of different card games.

It is a yet further object of the present invention to provide such a deck wherein some games require less than the full deck of cards whereas other games require the full deck of cards.

These and other objects and aspects of the present invention may be better understood by reading the instant specification while referring to the drawing figures.

SPECIFIC DESCRIPTION OF THE PREFERRED EMBODIMENT

Figure 1:
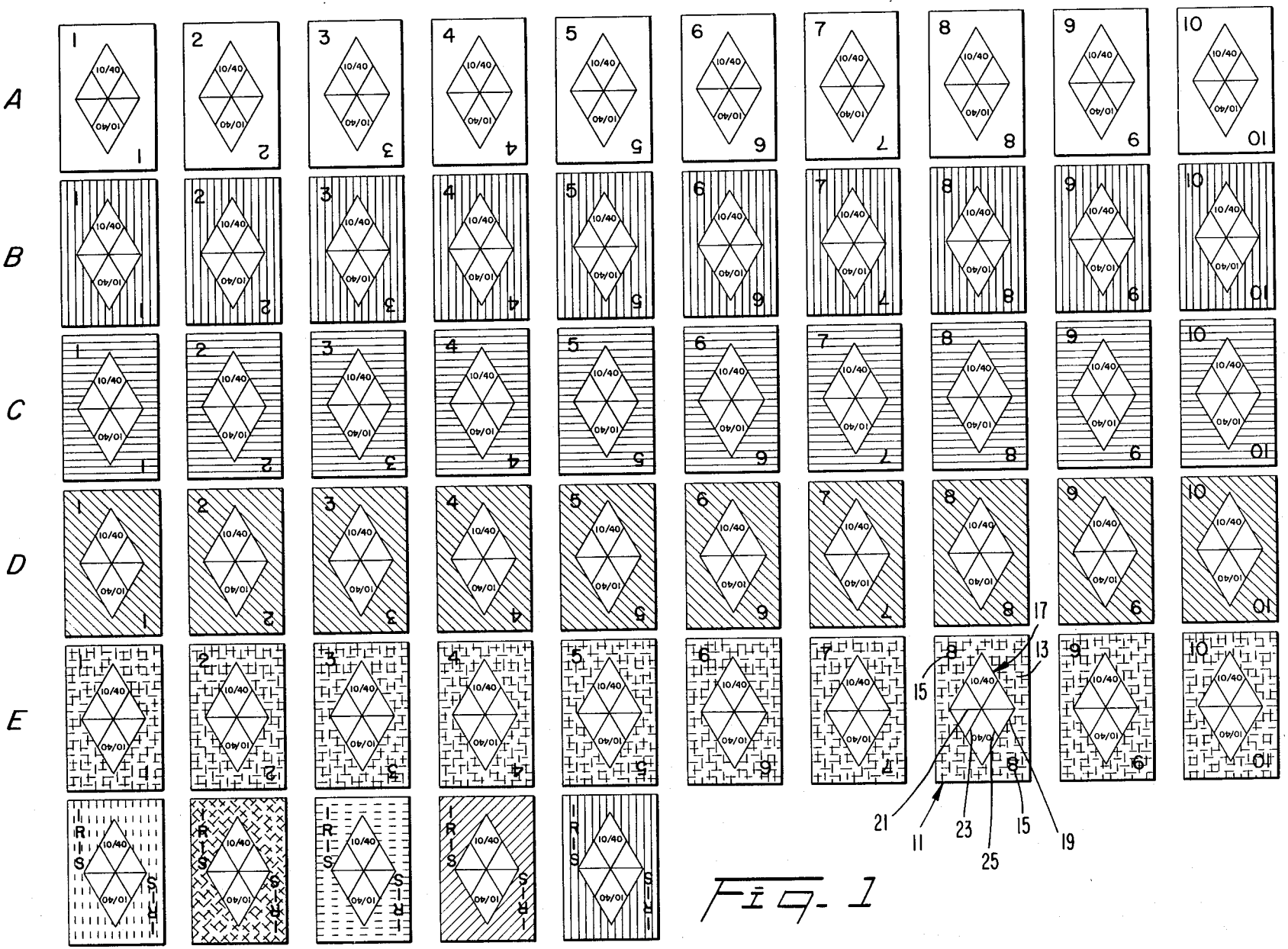
FIG. 1 shows a representation of the respective faces of the 55 cards contained in the deck of cards of the present invention.

As shown in the figure, the deck of playing cards which forms the basis of the present invention includes suits A, B, C, D and E. In the preferred embodiment, each of these suits A through E includes 10 cards numbered with the numbers 1 through 10 with each suit having it own distinctive color. An example of one suitable color scheme would be suit A being white, suit B being red, suit C being blue, suit D being green and suit E being gold. This color scheme is only to be considered exemplary and any color scheme may be used with the 5 suits so long as each suit comprises playing cards of a color different from the color of respective other suits. In addition to the 5 suits above described, the inventive deck includes 5 additional cards each of which includes the word "iris" written thereon as shown in the figure. Each of these 5 "iris" cards has a distinct color different not only from each other iris card but also different from the respective colors of the respective suits A through E.

Each of the 55 cards has a similar design pattern on its playing face. The card 11 is representative of this design and is seen to include a playing face 13, a number 15 located in opposed corners of the playing face 13, and a diamond shaped area 17. The diamond shaped area 17 includes a diamond periphery 19, a line 21 extending horizontally across the diamond and bisecting it, and 2 further lines 23 and 25 which form an X which bisects the line 21 and divides the diamond 17 in conjunction with the line 21 into 6 different sections, 2 of which are diamond shaped and 4 of which are triangularly shaped. As noted the card 11 is exemplary in face design of the respective faces of the other 54 cards in the deck.

As such, it is seen that the inventive deck of playing cards includes cards of 10 different colors, with 50 of the cards being divided up into 5 suits of 10 cards each with each suit being of a distinct color, and 5 further iris cards each of which has its own distinct color which is distinct from the colors of the suit cards.

Some games have been devised which may be used in conjunction with the inventive deck of cards. In some of these games, some of the cards are not used and thus less than the entire deck is used for these games. In other games, all of the cards in the deck are used. Below, a description of various games which may be played with the inventive deck of cards will be described.

GAMES PLAYED WITH THE DECK OF CARDS OF THE PRESENT INVENTION

As stated hereinabove, the deck of cards as disclosed in the present invention may be utilized to play a large number of card-type games, with the number of such games only being limited by the imagination of the user or users thereof. Hereinbelow a few examples of card games which may be played with the above described deck of cards are set forth:

(1) A first game devised by applicant for use in conjunction with the deck of cards in the present invention is called "Color Draw". In this game, there are 2 to 5 players at each table. After establishing limits for betting and raising of bets, the procedure for cutting for the deal is completed and every player antes the initial bet. After the ante, each player is dealt 7 cards, one at a time face down. This procedure is followed by a round of betting wherein the players either bet or drop. The object of the game is to get a hand of 7 different colors. In the bet or drop phase, a player may draw up to two cards and discard the same number of cards drawn. After this procedure is completed a betting round is done. The players still remaining in the game may draw a maximum of 2 further cards and then a final round of betting is completed. At this point a show down of 7 cards is done and the player holding the greatest number of different colors wins. In case of a tie, the high cards in a hand will prevail.

(2) A second game devised by applicant and usable in conjunction with the deck of cards of the present invention is entitled "Quest." In playing the game of "Quest," the iris cards are removed and all cards marked number 1 are also removed thus leaving 45 color cards in the deck divided into 5 suits of 9 cards each with each suit being of a different color from the other suits. In playing the game, there are 4 players at each table with partners facing each other across the table. All color series (or no-trump) have the same rank. Each color card is ranked by the number on it with the numbers 2 through 10 being included in the deck.

Players select a card from a pack of cards spread face down on the table. The first player to draw the highest ranking card becomes the dealer and the next highest card holder becomes the partner of the dealer. The other 2 players also become partners. It is not important who shuffles the cards and the dealer may, if desired, elect to shuffle last. Customarily, the turns for dealing, bidding and playing pass to the left. A "call" is either a pass, a bid, a double or a re-double. Further, the player to the left of the dealer calls first.

Each player has a right to make a maximum of 3 calls—this means that after 3 rounds of calls the bidding is then closed. If all players pass, the turn passes for another deal. When a bid, double or re-double is followed by passes by all other players, the bidding is closed. Doubling and re-doubling do not affect the ranking of bids but do constitute a call. A bid undertakes to win more than 5 tricks with the named color as trump, or in no-trump. The first bid names the number of tricks above 5 the team has contracted to win.

If a player doubles the previous bid by an opponent, he wishes the scoring values to be doubled if in fact the contract is played. A re-double by the side having been doubled desires the doubled values to be doubled if in fact the contract is played. A doubled or re-doubled contract may be overcalled by a bid sufficient to overcall that contract not doubled. (bid 1 trick above the doubled contract).

In dealing, the dealer gives 5 cards one at a time to each player and to a "widow" in the center of the table, as such 5 piles of 5 cards are dealt. The dealer then continues to deal one card at a time to the 4 players so that each player initially has 10 cards with 5 cards being located in the widow. In the first round of bidding, each player has a right to name a color or no-trump at the level of 1, or at the same level of a previous call. (This means that each player, having a bid remaining in a round of bidding, may call at the same level as a previous bid.) Subsequent bids must be above the level of a previous bid. For example, if a player bids two of a color or no-trump, all players having a bid remaining in that round may call 2 or any other color or no-trump. If necessary the third and final round of bidding will determine the contract, ending the bidding. The highest number of tricks bid in any color or no-trump becomes the contract. The player who first makes a high bid of 2, 3, 4 or 5 in the final round of bidding wins the contract. The player who first named the color or no-trump for the team becomes the contractor. The contractor then takes the widow in his hand and holds any cards desired then discards 5 cards face down so that he ends up holding any 10 cards.

To begin play, the person to the left of the contractor places a card, face up, in the center of the table; the other players, in rotation to the left must play a card of the same color, if possible, but if unable to do so may play any card. A trick (4 cards) containing a trump is won by the highest ranking trump played. If the trick does not contain a trump the highest ranking card of the color led wins the trick. The winner of a trick leads to the next. The contractor and the defender winning the first trick for the side, place a trick won face down on the table. Tricks are arranged so that each side may see the number of tricks won.

The scoring may be done by any player. The score sheet will have 2 columns, one for each team. A horizontal line is drawn so that about ⅓ of the sheet is below the line. Scores for tricks bid and made are entered below the line. Other scores such as over tricks, tricks won by the defenders, bonuses and under trick penalties are entered above the line. A team scores 10 points for each trick won including those in the book (5 tricks). Eighty points is a game. (below the line) This means making at least a 3 bid if the game is to be made in one deal. Each side starts a new game with no score. If the contractors make or exceed the number of tricks bid, they receive 10 points for each trick, however, only those bid and made are scored below the line. If the bid is not made, the contractors receive no credit for tricks won; and the defenders are awarded a bonus of 100 points for each trick below the bid. Further, a bid of 5 tricks, when made, is a slam and scores 200 bonus points. The team winning 2 of 3 games is the winner of a "rubber" and adds 300 points to the score.

At the conclusion of a rubber, all points in each column of the score sheet are added and checked. The side having the higher total scores declared the winner. After each rubber there may be a new draw for partnerships or there may be a rotation to other tables.

(3) A third game playable with the deck of cards of the present invention is entitled "Draw". In the game of Draw, first limits are established for betting and raising. A cut for the deal is made and the ante. Four cards are dealt one at a time face down followed by a betting round. The player to the left of the dealer opens the betting. (bet or drop out) Two cards are drawn followed by a betting round.

A player may stand pat by discarding one card or discarding one or two cards and drawing the same number of cards. There is a final round of betting and each player then discards 1 card holding 5 cards for a show down face up on the table. If no player opens the betting, ante and deal.

The scoring is as follows under the high-low system and with each card having the value of the number written thereon: The maximum high score is 40 points and any score above 40 is considered to be a "bust" and not playable. Forty points beats a low score of 11 or above. A low of exactly 10 points wins all the pot and a low of less than 10 points splits the pot with the high hand. If no player holds exactly 40 points high and low split the pot. Two or more players holding exactly 10 or exactly 40 points or the same low score less than 10 points will share their part of the pot, whereas, hands identical in all respect are considered to be tied.

(4) A fourth game playable with the deck of cards of the present invention is entitled "Iris" (Goddess Of The Rainbow). In this game 2 to 5 players may participate or if more than 5 players are present additional tables may be used. A host or hostess may deal for the entire game or otherwise a cut for the deal is made. The object of the game is to get a hand of 6 different colors. Each player is dealt 6 cards one at a time and each player in succession beginning at the dealers left may draw up to 2 cards and discard the same number of cards drawn. This procedure is continued for each round of dealing until a player holds 6 cards of a different color. When a player holds such a hand (iris) he or she may lay the cards on the table as soon as that round of dealing is completed. Such a hand scores 10 points and if made without a draw 20 points are scored. All iris hands score and the first player to score 100 points wins the game. If agreed upon before the game, the other players will pay the winner either a set amount or for the difference in the scores.

Figure 2:
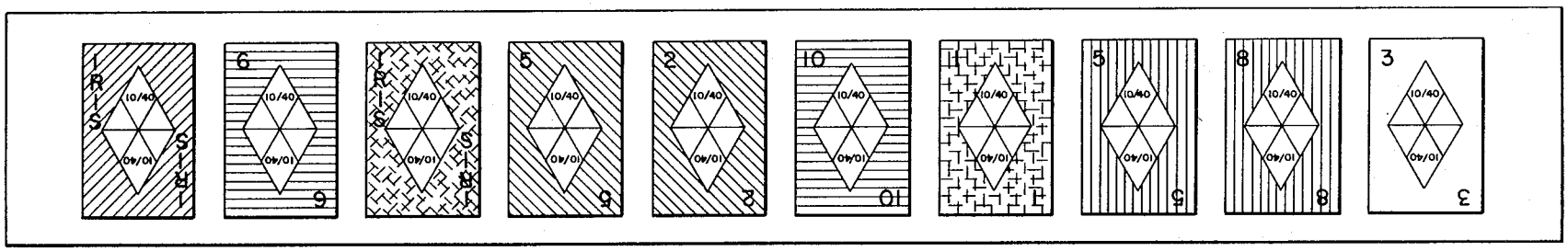
FIG. 2 shows an exemplary rack usable with the deck of FIG. 1 to play a game as described hereinafter.

(5) A fifth game playable with the deck of cards of the present invention is entitled "Strike Bowling". The game of strike bowling is played with a set of 5 or more different racks and a pack of color cards. (a rack is an arrangement of color numbers 1–10, an example of which is shown in FIG. 2) A great number of racks may be devised by using the 10 colors provided by the complete pack. Anyone may deal the cards, however, it is customary for a host or hostess to perform all of the dealing chores. To begin the game, the cards are shuffled, cut and placed face down on a table. The dealer turns the top card face up in the center of the table and calls the color number, such as blue 8. The player having that color number in his or her rack covers the square using tokens, coins etc. The deal is continued one card at a time until a player has covered all 10 squares in the rack whereupon the player yells "strike" and the deal is then ended. New deals are begun and proceed as described in the first deal until 10 deals have been made. Each deal is referred to as a frame on the score sheet. The score sheet has a horizontal row of 10 squares called frames for each player and the scoring in each frame is as follows:

strike—10 points
double (two consecutive strikes)—20 points
triple (three consecutive strikes)—40 points.

Twenty or more points for each additional strike in the string. Other players score one point for each square covered up to a total of 9. The score in a frame is added to the score in the previous frame and the highest total score recorded cumulatively through the tenth frame wins the game. This game may be played as a series of three games with the player having the highest total score for the 3 games winning the series.

(6) A sixth game which may be used with the deck of cards of the present invention is entitled "3-2 Color Rummy". In this game there may be 2 or more players with 2 to 4 being at each table. In the beginning a cut is made for the deal and the deal is then progressive to the left. Each player is dealt 7 cards one at a time and the undealt cards called the "stock" are placed face down in the center of the table. The top card is turned face up and placed beside the stock forming the "up pile". The object of this game is to form the cards in each hand into spreads of 3 cards in a color sequence, for example, red 6, red 7, red 8, and 2 iris cards. (a spread must be a 3 card straight flush or 2 iris cards) Additional iris cards and those matching a color sequence may be laid off in a later round of play. The player at the left of the dealer plays first and progresses to the left. Each player adheres to the following order:

(1) May spread (face up on the table) and discard one card, or draw a card from the stock or the up pile (top one only) and discard one card. If a card is drawn from the up pile a spread must be made using that card and one card is discarded. After a draw from the stock a player may also take a card from the up pile if a spread is made by using that card, but only one card is discarded. (Discards are turned face up and placed on the up pile.)

(2) A player may lay off an appropriate card from the hand on any spread on the table, and discard one card. In other words, a player may draw and discard, spread and discard or lay off and discard.

Play ends when any player gets rid of all cards in the hand. (the player going out need not make a final discard) If no player has gone out when the stock is depleted, play continues as long as a successive player can lay off, spread, or draw from the up pile; but ends when no player can make a play. When play ends, each player counts the total value of all cards remaining in the hand and that amount is entered on the score sheet. In this regard, each iris card has a value of 10 and the other 50 cards have a numerical value equal to their particular number on the face thereof. The game ends when a player score reaches 100 or more and the player with the lowest score wins the game.

It is noted here that the word "suit" has been used herein to distinguish the above described different colored groups of cards. The word "suit" pertaining to playing cards has been defined in Webster's Dictionary as "all the cards in a pack bearing the same pip." Since the cards disclosed herein have no "pips" per se thereon their designation as "suits" may not be totally descriptive thereof. As such, the above disclosed different colored groups of cards may, if desired, be considered to comprise "Color Sets," "Color Sequences" or "Color Combinations."

It is further noted that the colors used in FIG. 1 are to be construed as only exemplary and any combination of colors or other distinguishing feature or features may be utilized to form a basis of distinction between the various cards.

As such, a deck of cards has been disclosed which is usable to play a number of interesting and challenging card games. It is submitted here that various modifications and alterations of the present invention may be made without departing from the intended scope thereof. As such, it is intended that the scope of the invention only be limited by the following claims.

I claim:

1. A deck of playing cards comprising (a) five distinct suits of cards, each said suit including ten cards consecutively numbered from one to ten with all cards having the same face design; and (b) at least three additional cards, each said additional card being un-numbered and including identifying wording thereon distinguishing from said suits while also having said same face design;

(c) each of said suits being of a color distinct from the colors of each of the other suits;

(d) each of said additional cards being of a color different from the color of any other additional card and different from the colors of said five suits; and (e) each said additional card comprising a unique entity not included in any suit and not comprising a suit.

2. The invention of claim 1, wherein said deck includes five of said additional cards.

* * * * *